US012065792B2

(12) United States Patent
Schlipper

(10) Patent No.: US 12,065,792 B2
(45) Date of Patent: Aug. 20, 2024

(54) HELIDECK SAFETY NET

(71) Applicant: MRM HK LIMITED, Western District (HK)

(72) Inventor: Robert Wesley Schlipper, Western District (HK)

(73) Assignee: MRM HK Limited, Western District (HK)

( * ) Notice: Subject to any disclaimer, the term of this patent is extended or adjusted under 35 U.S.C. 154(b) by 45 days.

(21) Appl. No.: 17/971,787

(22) Filed: Oct. 24, 2022

(65) Prior Publication Data

US 2023/0058229 A1 Feb. 23, 2023

Related U.S. Application Data

(63) Continuation of application No. PCT/CN2021/089417, filed on Apr. 23, 2021.

(51) Int. Cl.
*E04G 21/32* (2006.01)
*E01F 3/00* (2006.01)

(52) U.S. Cl.
CPC ..... *E01F 3/00* (2013.01)

(58) Field of Classification Search
CPC ..... E04F 13/00; E04F 11/18; E04G 21/3261; E04G 21/3266; B63B 7/04; B63B 35/52; E04H 17/06; A63B 71/022
USPC ..... 256/47
See application file for complete search history.

(56) References Cited

U.S. PATENT DOCUMENTS 1,127,493 A * 2/1915 Nagy ..... E06B 3/485 256/26
3,527,319 A * 9/1970 Pedley ..... A62B 1/22 182/139
4,290,602 A * 9/1981 Kennedy ..... E04H 17/05 473/434
4,981,225 A * 1/1991 Cole ..... B65G 1/02 211/208
4,982,813 A * 1/1991 Starr ..... E04G 21/3261 182/138
6,098,750 A * 8/2000 Reynolds ..... E04G 21/3261 182/138

(Continued)

FOREIGN PATENT DOCUMENTS

CN 105484174 4/2016
CN 207597288 7/2018

(Continued)

OTHER PUBLICATIONS

Written Opinion of CN Searching Authority in PCT/CN2021/089417.

*Primary Examiner* — William V Gilbert

(74) *Attorney, Agent, or Firm* — Renner, Kenner, Greive, Bobak, Taylor & Weber

(57) ABSTRACT

A helideck safety net assembly that can be readily installed and removed includes a net, spreader bars adapted to pass through the cells at longitudinally opposing edges of the net and an edge line adapted to secure the net inside a perimeter frame by being wound generally helically in loops around the perimeter frame. The net is formed of lengths of line arrayed in the longitudinal direction alongside one another, and fastening means that join adjacent lengths pairwise at intervals to form cells of the net, wherein an end row of cells is formed at both longitudinally opposing edges of the net, and a longitudinal row of cells is formed at both longitudinal edges of the net.

18 Claims, 6 Drawing Sheets

(56) References Cited

U.S. PATENT DOCUMENTS

| | | | | |
|---|---|---|---|---|
| 6,857,504 | B1 * | 2/2005 | Branter | E04G 21/3266 248/237 |
| 2002/0144965 | A1 * | 10/2002 | Calleja | F16P 1/00 211/183 |

FOREIGN PATENT DOCUMENTS

| | | |
|---|---|---|
| CN | 208632988 | 3/2019 |
| CN | 209907276 | 1/2020 |
| JP | 3213158 | 10/2017 |
| KR | 20140036645 | 3/2014 |
| TW | 514691 | 12/2022 |

* cited by examiner

HELIDECK SAFETY NET

TECHNICAL FIELD

The present invention relates to a safety net for a helideck, such as may be provided on a perimeter of the helideck.

BACKGROUND OF THE INVENTION

In the oil and gas and marine industries, helicopter access is accommodated on drilling rigs, ships and other offshore structures by a helideck for helicopter take-off and landing. Helidecks are also used onshore on buildings and like elevated structures where helideck safety nets, or perimeter nets, contribute to the safety of helicopter operations due to their capability to arrest and restrain a person or item falling off an edge of the helideck, without causing injury or damage.

Beyond the fundamental requirement for providing an energy absorbent structure able to safely withstand the required loads in a cost-effective manner, the harsh environment in which it is used means that the netting system must have an operational life, after which it should be replaced. However, many prior art solutions have features that make installation and uninstallation of perimeter nets relatively problematic. For instance, the net fastening may require multiple tools or multiple fasteners that are time-consuming to install and present a drop hazard, or produce localised weaknesses from stress concentration, and it is particularly advantageous to avoid welding that may also present a fire danger.

It is an object of the present invention to overcome or substantially ameliorate the above disadvantages or, more generally, to provide an improved helideck safety net.

DISCLOSURE OF THE INVENTION

According to one aspect of the present invention there is provided a helideck safety net including:

a net elongated in a longitudinal direction, the net formed of lengths of line arrayed in the longitudinal direction alongside one another, and fastening means that join adjacent lengths at intervals to form cells of the net, wherein a longitudinal row of cells is formed on longitudinal edges of the net and the longitudinal edges are joined by at least one end edge, wherein an end row of cells is formed along the at least one end edge, at least one spreader bar adapted to pass through the cells of one of the end rows, and an edge line adapted to secure the net inside a perimeter frame by being wound generally helically in loops around the perimeter frame, each loop passing through a cell of the longitudinal rows, and through a cell of the end rows and simultaneously inside the at least one spreader bar to secure the spreader bar to the perimeter frame, wherein the at least one spreader bar includes an array of openings through which the edge line can be threaded to fix the ends of the edge line.

Not only is this helideck safety net more readily installed and uninstalled, it has been found that under drop testing, providing a spreader bar according to the invention has provided a significant increase in the load at which the net first starts to fail, compared to nets secured by the edge line alone and it is believed that this is achieved by better distribution of loads away from highly loaded lengths.

While the line forming the lengths may comprise a rope or tape of natural and/or synthetic fibres, this line is preferably formed of wire, or like resilient material to provide bending resilience. Otherwise, for instance, a rope or tape of natural and/or synthetic fibres may be reinforced by a wire to provide a line with bending resilience. The bending resilience is advantageous in a net of this construction, as it tends to naturally collapse to close the cells as the lengths return to their original, generally straight, form. Advantageously, with the lengths adjacent one another, the collapsed net forms a bundle that is elongate and compact in the transverse direction and so can be wound on a narrow coil, avoiding the need for folding the net for transport, or winding the net onto a coil that is the full width of the net.

Preferably the at least one end edge comprises a pair of end edges that are longitudinally opposing, each end edge comprising a respective end row of cells, and the at least one spreader bar comprises a pair of spreader bars that are each adapted to pass through the cells of one of the end rows.

The net may be formed to suit the perimeter frame, and in particular may be sized so that when installed and properly tensioned, the edges of the net are spaced inward from the perimeter members of the perimeter frame. Typically the net will have straight longitudinal edges that are parallel, which is advantageous for simple net construction, but not essential, and all the edges may be curved.

Preferably the wire is a multi-strand wire, such as a twisted wire i.e. a twisted wire cable or rope.

Preferably the fastening means comprise crimps, ferrules, welds, or the like, that permanently fasten the lengths.

Preferably the line forming the lengths and the edge line are of the same construction.

Preferably the spreader bars are tubular. The smooth external shape of the spreader bars is believed to contribute to their performance. In this regard, rectangular or triangular hollow sections have a sufficiently smooth external shape owing to their rounded corners, and may perform satisfactorily. Alternatively, the spreader bars may be of solid material.

Preferably the net, edge line and spreader bars are constructed of the same material, particularly from inherently corrosion resistant steel.

Preferably the openings of the array of openings extend transversely through the spreader bar, and are axially spaced apart.

Preferably the openings are disposed in coaxial pairs in diametrically opposing wall parts of the spreader bar.

Preferably central axes of the openings generally lie in longitudinal plane that bisects the spreader bar.

Preferably a notch is formed in each of the longitudinally opposing ends of the spreader bar, the notches adapted to receive parts on transversely opposing edges of the net to spread the net transversely.

Preferably the notch comprises notch parts in diametrically opposed sections of the respective end of the spreader bar, an axis of the notch being aligned generally orthogonal to the central axes of the openings.

Preferably the helideck safety net further comprises the perimeter of frame, which may comprise parallel outer and inner longitudinal members joined by shorter transversely extending inclined members.

In another aspect, the invention provides a method for installing a helideck safety net, the method including:

providing a first net elongated in a longitudinal direction, the net formed of lengths of line arrayed in the longitudinal direction alongside one another, and fastening means that join adjacent lengths at intervals to form cells of the net, wherein an end row of cells is formed at both longitudinally opposing edges of the net, and a longitudinal row of cells is formed at both longitudinal edges of the net, providing a spreader bar having an array of openings;

passing the spreader bar through the cells of one of the end rows, and generally helically winding an edge line in loops around a perimeter frame to secure the net inside the perimeter frame, the generally helically winding comprising passing each loop through a cell of the longitudinal rows, and through a cell of the end rows and simultaneously inside the spreader bars to secure the spreader bars to the perimeter frame, and threading the edge line through consecutive ones of the openings to fix an end of the edge line to the spreader bar.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
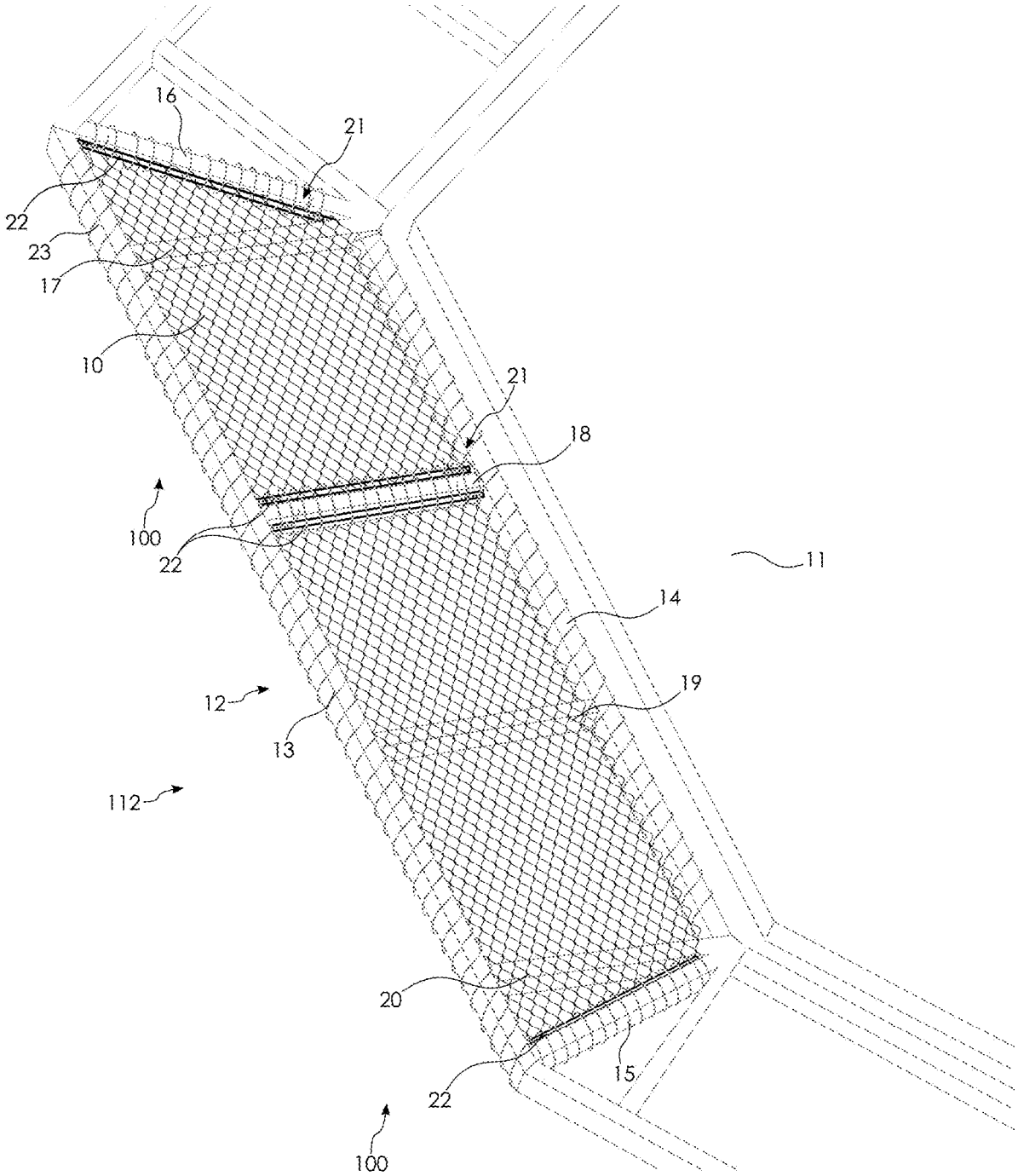
FIG. 1 is a perspective view of an embodiment of a helideck safety net according to the invention.

Referring to FIG. 1, helideck safety nets or net assemblies 100 are shown installed alongside one edge of a helideck 11 and fixed inside a perimeter frame 12. On the octagonal helideck 11 that is shown, the perimeter frame 12 may extend around all eight sides for holding safety nets 100 around the entire perimeter, with the frame 12 being fixed to underlying or adjacent structure (that is not shown in the drawing). The safety net assemblies 100 may be adapted to suit the perimeter frame 12, and may include trapezium-shaped nets 10 (two of which are shown in FIG. 1).

The perimeter of frame 12 may comprise like elongate members 13, 14, as with inner member 14 disposed alongside an edge of the helideck 11 and outer member 13 offset outward and generally parallel. Cross members 15-20 are relatively shorter and extend between the inner and outer members 13 and 14 to which they may be welded at their respective ends. The assembly of the members 13-20 may be considered as a sub-frame 112 in which component members 13-20 are generally coplanar, and either horizontal or inclined with the inner and outer members 13 and 14 horizontal, but with the outer member 13 relatively higher. The cross members 15-20 may be transverse (in the case of cross members 17-20), or inclined (as in the case of cross members 15 and 16). The complete frame 12 for the octagonal helideck 11 shown may be effectively an assembly of eight sub frames 112 joined at their ends (where they share the inclined cross members 15, 16). It will be understood that this is an example, and the perimeter frame 12 need not take this shape, and need not have straight edges, and may have more or less than the number of members shown here.

The safety net assembly 100 shown in FIG. 1 includes the two nets 10 that together close the perimeter frame 12, and both include a net 10 elongated in a longitudinal direction that is trapezium shaped. An end row 21 of cells is formed at both longitudinally opposing transverse edges of each net 10 and two spreader bars 22 are used, each passing through the cells of a respective one of the end rows 21, as in a woven manner.

Securing the spreader bars 22 and the transverse edges of the nets 10 is an edge line 23 that is wound generally helically in loops, each loop going through a cell 28 of the end rows 21 and simultaneously inside the spreader bars 22 and around adjacent ones of the cross members 15, 16 and 18.

This same edge line 23 may extend in loops around the longitudinal members 13, 14 and through cells at the longitudinal edges of the nets 10, for the purpose of fixing the nets 10 to the frame 12.

Figure 2:
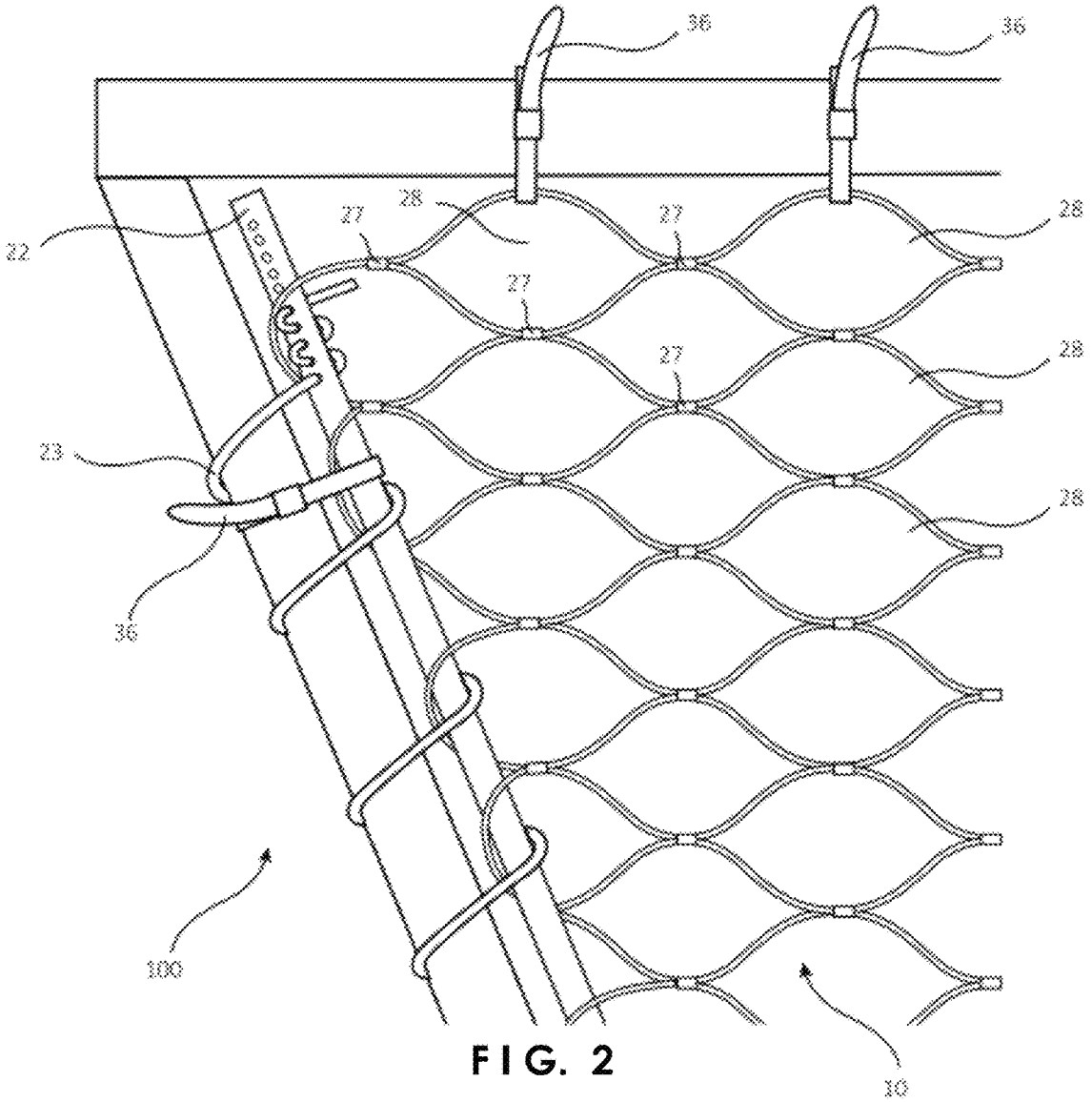
FIG. 2 is an enlarged detail showing a helideck safety net according to the invention.
Figure 3:
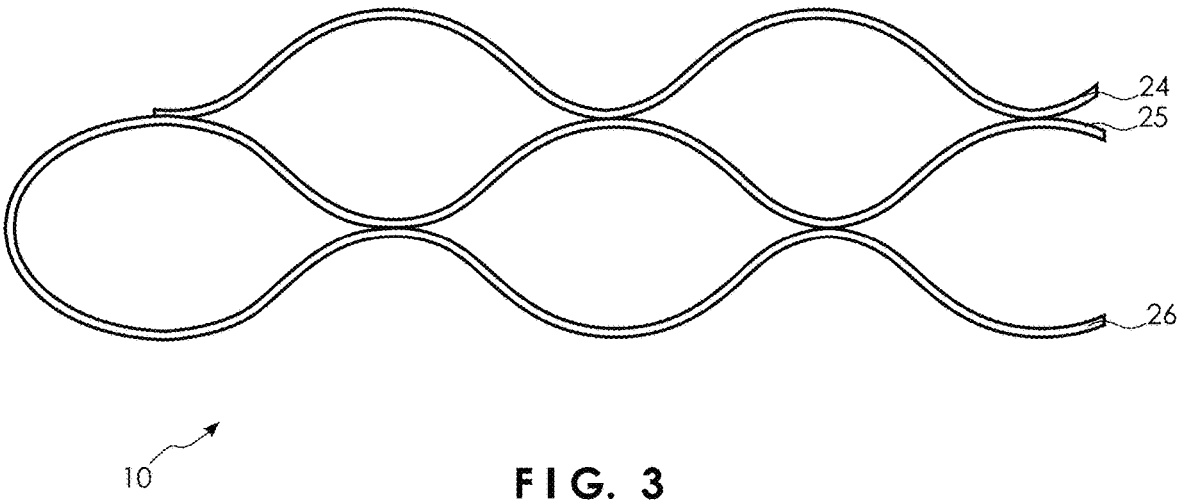
FIG. 3 shows the configuration of the lengths forming the net of FIG. 2.

FIGS. 2 and 3 show a preferred construction of the nets 10 which are made of line, preferably in the form of twisted strand wire lengths 24, 25, 26 etc arrayed in the longitudinal direction alongside one another. Nodes of the net 10 are formed by crimps 27 that provide fastening means and are plastically deformed to join adjacent lengths 24, 25, 26 pairwise at intervals to form cells 28 of the net 10.

The bending resilience of the wire lengths 24, 25, 26 means that a load must be applied to stretch the net 10 and spread the lengths to the position shown where they take up the sinusoidal wave-like form illustrated. In a relaxed state, the lengths 24, 25, 26 tend to be approximately straight, thus the net 10 has an inherent tendency to collapse transversely. A cell 28 at a longitudinal edge of the net may be formed by turning back one length on itself, so that a pair of adjacent lengths are integral. For instance, the lengths 25 and 26 are shown to be integral.

Figure 4:
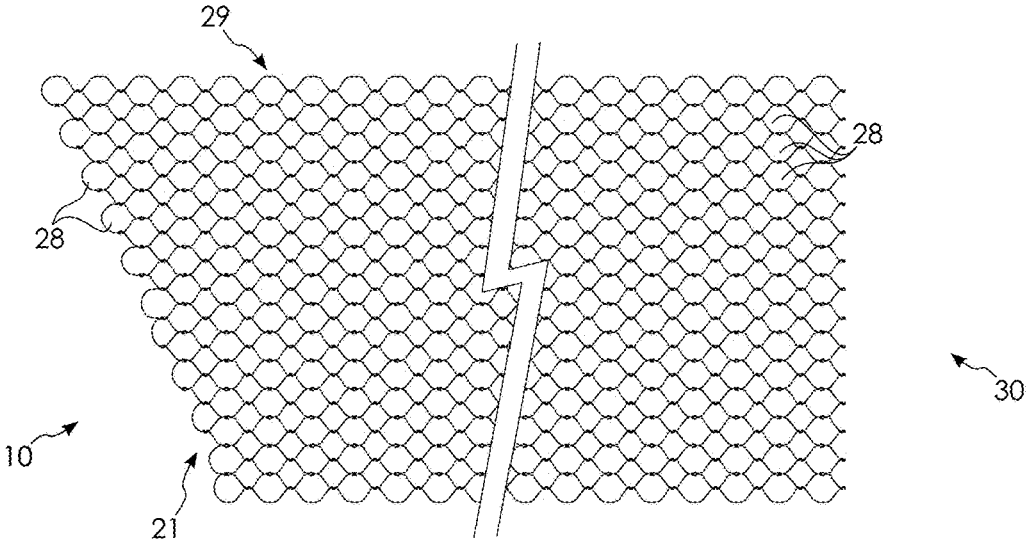
FIGS. 4, 5, and 6 are schematic illustrations of alternative constructions of the net of the helideck safety net according to the invention.

FIG. 4 shows one configuration of the net 10 to provide the trapezium shape of FIG. 1, where the inclined edge is formed with the edge row 21 of loops or cells 28 inclined to the longitudinal edge row 29, and formed by turning back one length 24, 25, 26 on itself. The other, approximately orthogonal, edge row 30 shown in FIG. 4, comprises cells 28 that are not formed by turning back the length by are instead closed by crimps 27 that lie along the edge.

Figure 5:
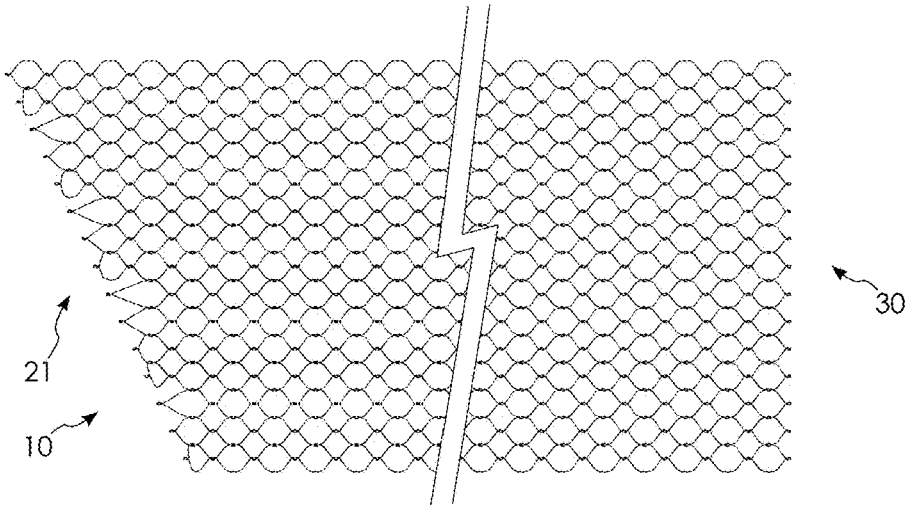

Correspondingly, the inclined edge row 21 need not comprise loops formed by turning back the length but may be formed instead by joining separate lengths at this transverse edge by crimps 27, as shown in FIG. 5.

Figure 6:
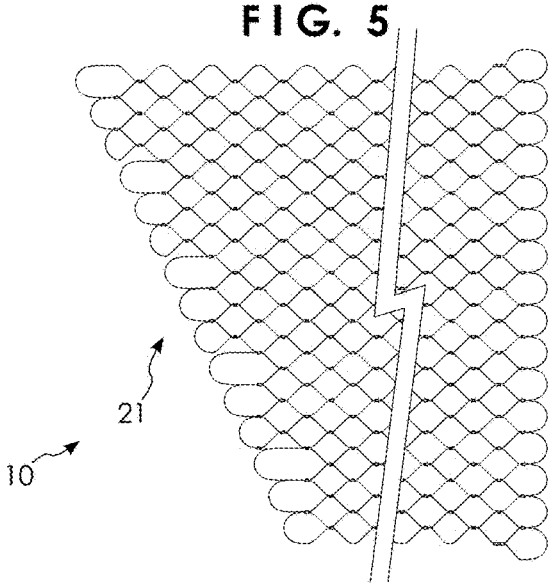

In fact all the lengths 24, 25, 26 comprising the net 10 may be integral, i.e. the net may be formed using a single line laid out in a boustrophedonic pattern, as shown in FIG. 6. This drawing also shows how the loops, or turned back sections, may be provided at both ends of each length. Of course, while making the net using a single line for form the lengths may offer advantages it is not essential to the invention.

Figure 7:
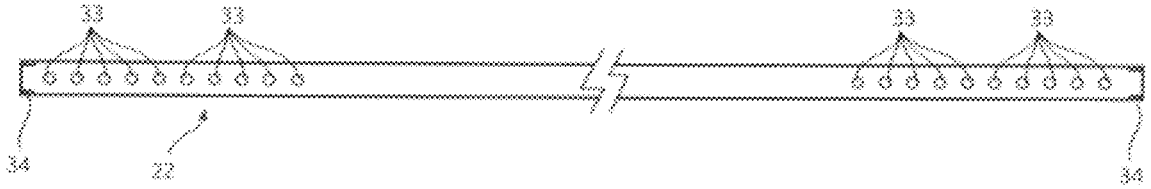
FIGS. 7 and 8 are plan views of alternative spreader bars of the helideck safety net according to the invention.
Figure 8:
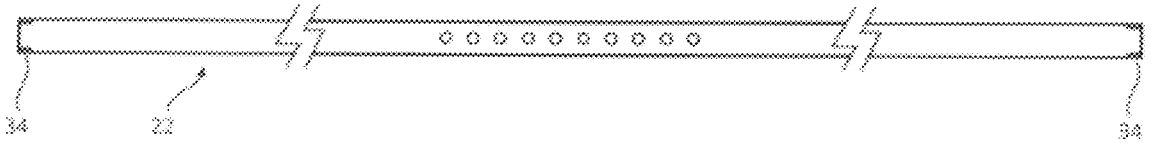

Two different examples of a spreader bar 22 are shown in FIGS. 7 and 8, and both are preferably tubular for a smooth external shape.

Openings 33 for receiving the edge line 23 are disposed in row and axially spaced apart. Each opening 33 may be circular, and extend transversely through the spreader bar 22 with the openings 33 disposed in coaxial pairs in diametrically opposing wall parts. Central axes of the openings 33 generally lie in a common longitudinal plane that equally bisects the spreader bar. The openings may be equally longitudinally spaced. The openings 33 may be arrayed in two sets, one set adjacent each longitudinal end (as per FIG. 7), or in a single set, as near the middle of the spreader bar 22 (as per FIG. 8).

A notch 34 is formed in each of the longitudinally opposing ends of the spreader bar 22, the notches adapted to receive parts on transversely opposing edges of the net 10 to spread the net 10 transversely. The notch 34 comprises notch parts in diametrically opposed sections of the respective end of the spreader bar, and an axis of the notch 34 lies generally orthogonal to the axes of the openings 33 that lie in the common longitudinal plane that equally bisects the spreader bar. This arrangement provides that the axis of the notches 34 lie approximately in the plane of the installed net, with the axes of the openings 33 substantially perpendicular to the plane of the installed net 10.

In use, the nets 10 are transported to the installation site, in a collapsed state, where their compact size and low weight is helpful. To install a net 10, a spreader bar 22 may be first installed along each transverse edge or end row 21 of cells 28, where it passes through each cell 28 in the row 21. By then inserting each longitudinal edge of the net 10 in a respective one of the notches 34, the resilience of the net 10 and its tendency to collapse transversely, ensures that the spreader bars 22 are firmly connected to the net 10. Optionally, prior to moving to the perimeter frame 12, one end of the edge line 23 may also be fixed to one of the spreader bars 22.

Figure 9:
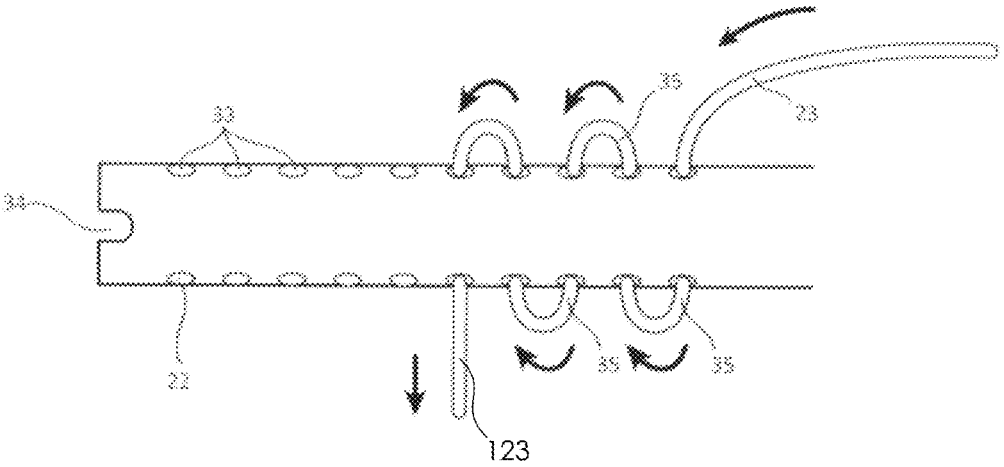
FIG. 9 is a schematic perspective view of the edge line fixed to one end of the spreader bar of FIG. 7.

FIG. 9 illustrates the fastening of the edge line 23 to the spreader bars 22, in which the edge line 23 is inserted back and forth through the openings 33, thereby providing a high degree of friction that prevents unwanted release of the line 23. The line 23 extends through the bar 22 and the openings 33 of one pair before a tight loop 35 reverses its direction, to extend through the next opening 33, which may be immediately adjacent. These steps are then repeated, as to form four, five or more loops 35. The end 123 of the edge line 23 may be directed vertically downward to prevent water ingress. When using a polymer coated 4 to 7 mm diameter wire edge line 23, a satisfactory fixing can be achieved by hand using this method i.e. without the need for tools.

Generally, the installation is then completed by placing the spreader bar 22 adjacent a transverse one of the members of the perimeter frame, for instance transverse member 16. Loop type fasteners 36, such as cable ties may be used to temporarily secure edges of the net 10 to the perimeter frame 12. The edge line 23 is then helically wrapped in loops about the transverse member, passing it through each cell 28 through which the spreader bar 22 itself extends, and inside the spreader bar 22, securing it firmly to the inside of the member 16. A like method is used to secure one longitudinal edges of the net 10, looping the edge line 23 through the cells 28 on the longitudinal edges.

Figure 10:
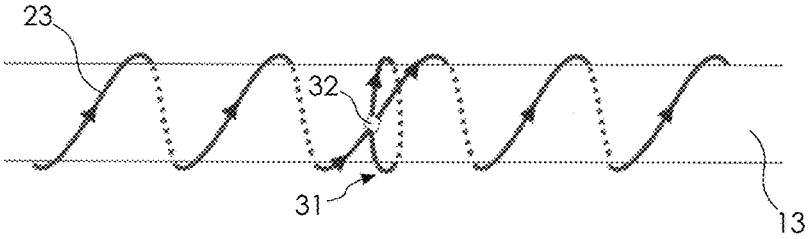
FIG. 10 is a schematic perspective view of a connection of the edge lone to a member of the frame for supporting the helideck safety net of the invention.

If a single edge line 23 extends around the entire perimeter of a net, the sections of this line 23 securing the opposing end rows 21 may be fixed to the respective spreader bar 22, as described above, by looping the line 23 through the openings 33. In this manner, each section is made independent, in that a break in one section, that extends between two sets of openings 33, does not affect the integrity of any other section so, for instance, a single break in the line 23 cannot allow the entire edge line 23 to be unwound. To divide the line 23 into further independent sections, the sections of the line 23 wound around the longitudinal members 13 and 14 can be separately fixed to these longitudinal members 13 and 14, as by a fastening loop 31 that is fixed to the edge line 23 by a crimped sleeve 32 or the like, as shown in FIG. 10 (where the net 100 is omitted for clarity).

When the frame 12 is made of dissimilar material to the (stainless steel of the) nets 100 and edge line 23, to mitigate the potential for galvanic corrosion, polymer strips (not shown) may be provided at the interface between the frame 12 and the nets 100, as where the nets overly the intermediate members 17, 19 and 20, to prevent contact between the frame 12 and the nets 100. Likewise, the nets 100 may be fixed inside the inner edges of the frame, as by about 20 mm, to avoid them making contact with the frame 12.

Multiple variations of the fastening steps of this method are possible, and it is of course unnecessary for a single edge line to be secured around the entire perimeter of the frame 12, with both line ends fixed to the same spreader bar 22. Advantageously, using two edges lines 23 allows the two spreader bars 22 and respective ends of the net to be first fixed to the perimeter frame 12, with the terminal ends of each of these two lines fixed, in the manner described above, to a respective one of the two spreader bars 22. Likewise, a single helical section of the edge line 23 around a single transverse member may simultaneously secure two spreader bars 22 on opposite sides, as in the member 18 in FIG. 1.

Figure 11:
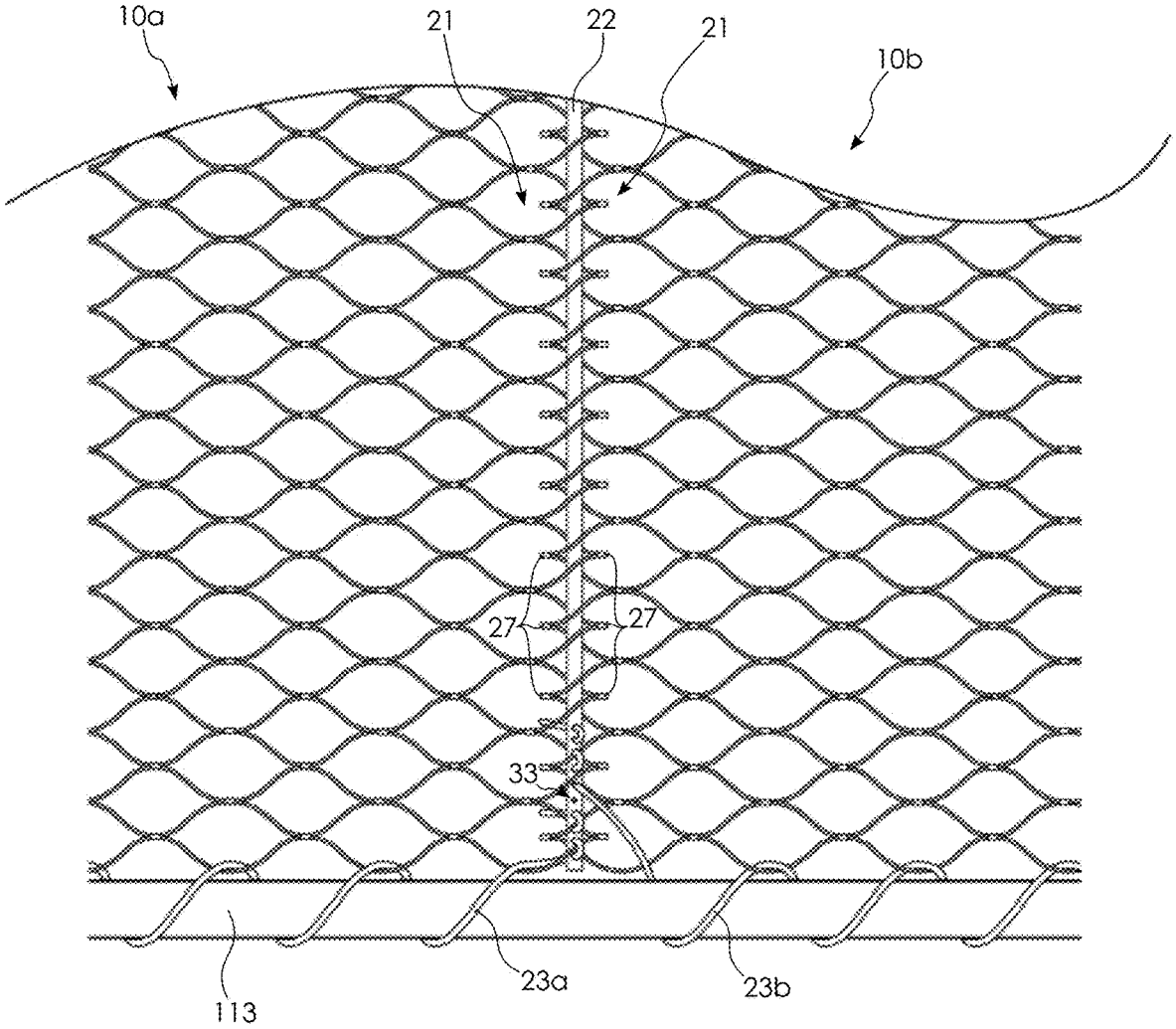
FIG. 11 is a fragmentary plan view of a single spreader bar used to join overlapping edges of two nets in the helideck safety net of the invention.
Figure 12:
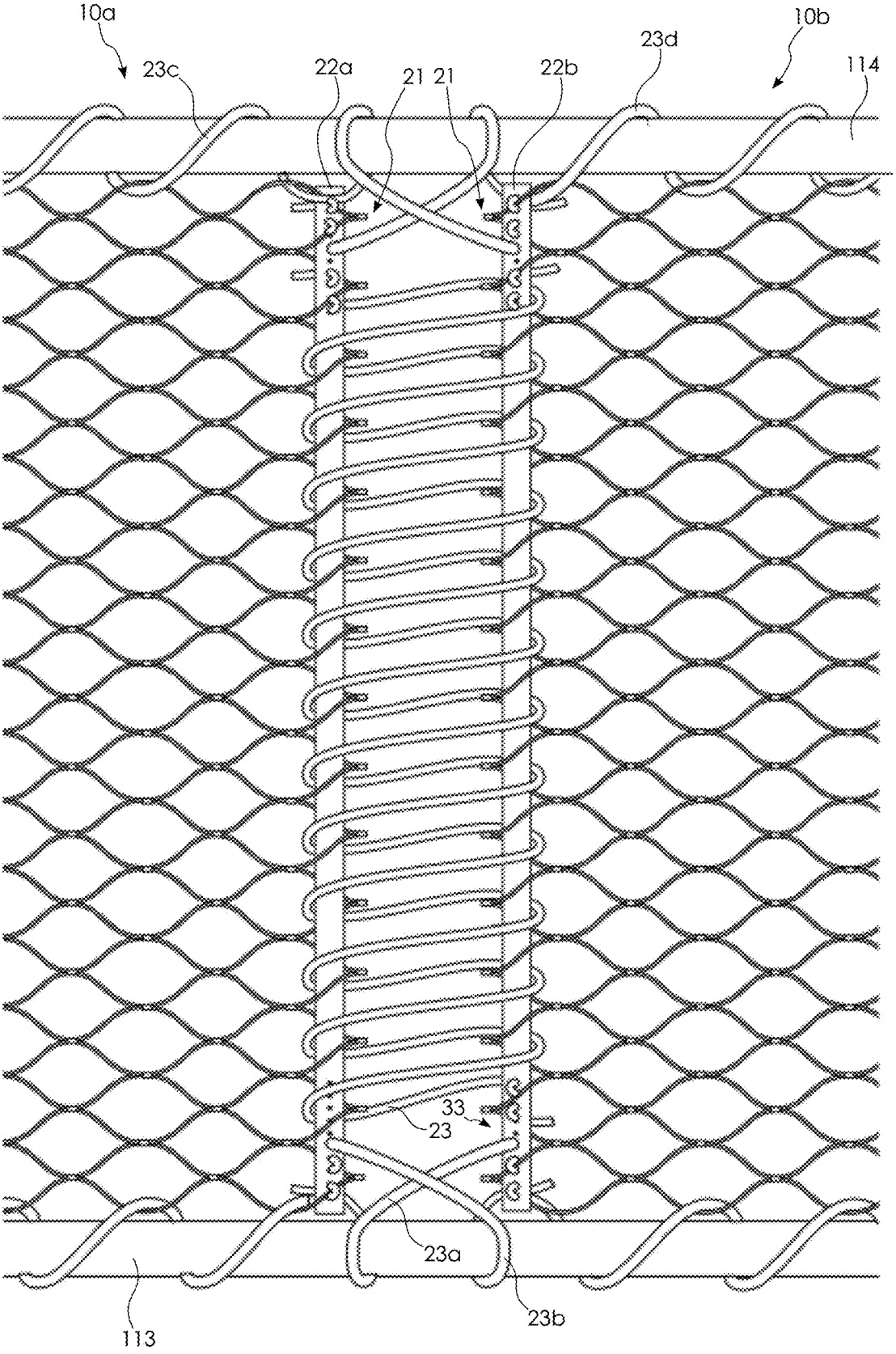
FIG. 12 is a plan view of a pair of spreader bars used to join longitudinally spaced edges of two nets in the helideck safety net of the invention.

FIGS. 11 and 12 illustrate another manner in which one or more spreader bars 22 may be used to fasten transverse edges of a net, in which the spreader bar 22 is used to connect two transverse edges together, as to join transverse edges of two nets that are either overlapping (FIG. 11), or longitudinally spaced apart (FIG. 12). In this different application, the use of the spreader bars 22 also offers similar advantages in terms of ease of installation and strength for improved ratings. In both FIGS. 11 and 12, adjacent ones of the lengths forming the nets 10*a*, 10*b* are joined by crimps 27, thereby forming the cells of the end rows 21 that defines these transverse edges.

FIG. 11 shows the use of a single spreader bar 22 to connect two transverse edges together, so as to join two nets 10*a*, 10*b* end-to-end. The spreader bar 22 passes through the cells the end rows 21 of net 10*a*, in a woven manner, and at the same time passes through the cells the end rows 21 of net 10*b*, in a woven manner. The spreader bar 22 may be secured in place by effectively connecting the two ends of the spreader bar 22 to the frame 12 using an edge line 23*a* that also serves to secures the longitudinal edges of the net 10*a* to adjacent members 113. This may be done by passing the edge line 23*a* sequentially through four adjacent ones of the openings 33 near the ends of the spreader bar 22, and passing the edge line 23*b* sequentially through adjacent ones of another set of the openings 33 near the ends of the spreader bar 22, thus providing the added security of fixing each end of the spreader bar 22 with two separate lines 23*a*, 23*b*.

An alternative arrangement, shown in FIG. 12, employs a pair of spreader bars 22*a*, 22*b*, each passing through the cells of the end rows 21 of a respective one of two nets 10*a*, 10*b*, in a woven manner. The edge line 23 is then used to connect the pair of spreader bars 22 together, by winding the edge line 23 in a helical manner around the outsides of both spreader bars 22. Opposite ends of the edge line 23 may be fixed to the spreader bars 22, in the manner described above, by passing it consecutively through the openings 36, as shown. A particular advantage of this arrangement is that varying the spacing between the spreader bars 22 provides a method for varying the length of the net.

The edge lines 23*a*, 23*c* used to secure the longitudinal edges of the net 10*a* to the member 113 may also secure opposite ends of the spreader bar 22*b* to the member 113 while, correspondingly, edge lines 23*b*, 23*d* used to secure the longitudinal edges of the net 10*b* to the member 113 may also secure opposite ends of the spreader bar 22*a* to the member 114.

Aspects of the present invention have been described by way of example only and it should be appreciated that modifications and additions may be made thereto without departing from the scope thereof.

The invention claimed is:

1. A helideck safety net including:

a net elongated in a longitudinal direction, the net formed of lengths of line arrayed in the longitudinal direction alongside one another, wherein adjacent lengths of the lengths of line are joined at intervals to form cells of the net, wherein a longitudinal row of cells is formed on longitudinal edges of the net and the longitudinal edges are joined by at least one end edge, wherein an end row of cells is formed along the at least one end edge, at least one spreader bar, each said at least one spreader bar adapted to pass through the cells of a respective end row of cells, and an edge line adapted to secure the net inside a perimeter frame by being wound generally helically in loops around the perimeter frame, whereby along the longitudinal rows of cells each said loop passes through a cell of the longitudinal rows of cells, and along the end rows of cells each said loop passes through a cell of the end rows and simultaneously inside the at least one spreader bar to secure the spreader bar to the perimeter frame, wherein the at least one spreader bar includes an array of openings through which the edge line can be threaded to fix the ends of the edge line.

2. The helideck safety net of claim 1 wherein the at least one end edge comprises a pair of end edges that are longitudinally opposing, each said end edge of the pair of end edges comprising a respective end row of cells, and the at least one spreader bar comprises a pair of spreader bars that are each adapted to pass through the cells of one of the end rows of cells.

3. The helideck safety net of claim 1 wherein the net is formed of wire to provide bending resilience.

4. The helideck safety net of claim 3 wherein the wire is a multi-strand wire.

5. The helideck safety net of claim 4 wherein the edge line is a multi-strand wire.

6. The helideck safety net of claim 1 wherein the adjacent lengths of the lengths of line are joined at intervals by crimps.

7. The helideck safety net of claim 1 wherein the at least one spreader bar is tubular.

8. The helideck safety net of claim 1 wherein the net, edge line and the at least one spreader bar is constructed of the same material.

9. The helideck safety net of claim 1 wherein the net, edge line and the at least one spreader bar is constructed from inherently corrosion resistant steel.

10. The helideck safety net of claim 1 wherein the openings of the array of openings extend transversely through the at least one spreader bar, and are axially spaced apart.

11. The helideck safety net of claim 10 wherein the openings are disposed in coaxial pairs in diametrically opposing wall parts of the at least one spreader bar.

12. The helideck safety net of claim 10 wherein central axes of the openings generally lie in longitudinal plane that bisects the at least one spreader bar.

13. The helideck safety net of claim 1 wherein the at least one spreader bar has longitudinally opposing ends and a notch is formed in each of the longitudinally opposing ends, the notches adapted to receive parts on transversely opposing edges of the net to spread the net transversely.

14. The helideck safety net of claim 13 wherein each said notch comprises notch parts in diametrically opposed sections of the respective end of the spreader bar, an axis of each said notch being aligned generally orthogonal to the central axes of the openings.

15. The helideck safety net of claim 1 further comprising the perimeter frame, the perimeter frame including parallel outer and inner longitudinal members joined by shorter transversely extending inclined members.

16. A method for installing a helideck safety net, the method including:

providing a first net elongated in a longitudinal direction, the net formed of lengths of line arrayed in the longitudinal direction alongside one another, wherein adjacent lengths of the lengths of line are joined at intervals to form cells of the net, wherein an end row of cells is formed at both longitudinally opposing edges of the net, and a longitudinal row of cells is formed at both longitudinal edges of the net, providing a first spreader bar having an array of openings;

passing the first spreader bar through the cells of one of the end rows of cells, and generally helically winding an edge line in loops around a perimeter frame to secure the net inside the perimeter frame, wherein along the longitudinal rows of cells the generally helically winding comprises passing each said loop through a cell of the longitudinal rows of cells, and, along the one of the end rows of cells, passing each said loop through a cell of the one of the end rows of cells and simultaneously inside the first spreader bar to secure the first spreader bar to the perimeter frame, and threading the edge line through consecutive ones of the openings of the array of openings to fix an end of the edge line to the first spreader bar.

17. The method of claim 16, further comprising:

providing a second net elongated in a longitudinal direction, the second net formed of lengths of line arrayed in the longitudinal direction alongside one another, and wherein adjacent lengths of the lengths of line are joined at intervals to form cells of the net, wherein an end row of cells is formed at both longitudinally opposing edges of the net, and a longitudinal row of cells is formed at both longitudinal edges of the net, joining a first one of the end rows of the first net to a second one of the end rows of the second net by passing a second spreader bar through the cells of both the first one and the second one of the end rows, and connecting opposite ends of the second spreader bar to the frame using an edge line that secures adjacent ones of the longitudinal row of cells to the perimeter frame.

18. The method of claim 16, further comprising:

providing a second net elongated in a longitudinal direction, the second net formed of lengths of line arrayed in the longitudinal direction alongside one another, and wherein adjacent lengths of the lengths of line are joined at intervals to form cells of the net, wherein an end row of cells is formed at both longitudinally opposing edges of the net, and a longitudinal row of cells is formed at both longitudinal edges of the net, passing each of a pair of second spreader bars through the cells of a respective one of the end rows of a respective one of first and second nets, and to connect the first and second nets, winding a line in a helical manner around the outsides of the pair of second spreader bars.

* * * * *